US006511407B2

(12) United States Patent
Wahl

(10) Patent No.: US 6,511,407 B2
(45) Date of Patent: Jan. 28, 2003

(54) FEED MEANS FOR SHEETS, PARTICULARLY CREASING MEANS, AND METHOD FOR ADVANCING SHEETS

(75) Inventor: Karl Wahl, Neuffen (DE)

(73) Assignee: bielomatik Leuze GmbH & Co. (DE)

( * ) Notice: Subject to any disclaimer, the term of this patent is extended or adjusted under 35 U.S.C. 154(b) by 0 days.

(21) Appl. No.: 09/950,260

(22) Filed: Sep. 10, 2001

(65) Prior Publication Data

US 2002/0082151 A1 Jun. 27, 2002

Related U.S. Application Data

(63) Continuation of application No. 09/338,127, filed on Jun. 22, 1999, now abandoned.

(30) Foreign Application Priority Data

Jun. 25, 1998 (DE) ..... 198 28 300

(51) Int. Cl.[7] ..... B31B 1/26

(52) U.S. Cl. ..... 493/405; 493/406; 493/437; 493/444

(58) Field of Search ..... 493/397, 405, 493/406, 437, 444

(56) References Cited

U.S. PATENT DOCUMENTS

| | | | |
|---|---|---|---|
| 1,693,147 | A | 11/1928 | King |
| 3,493,226 | A | 2/1970 | Weir |
| 3,945,305 | A | 3/1976 | Barny |
| 4,569,672 | A | 2/1986 | Marion et al. |
| 5,057,069 | A | 10/1991 | Marion |
| 5,540,647 | A | 7/1996 | Weiermann et al. |
| 5,989,175 | A | 11/1999 | Kawanishi |

FOREIGN PATENT DOCUMENTS

| | | |
|---|---|---|
| DE | 365688 | 12/1922 |
| DE | 25 00 348 | 9/1975 |
| DE | 25 19 420 | 1/1977 |
| DE | 689 05 773 | 6/1990 |
| DE | 41 01 399 | 7/1992 |
| EP | 0 371 893 | 6/1990 |
| EP | 0 498 168 | 8/1992 |
| FR | 2 412 485 | 7/1979 |

*Primary Examiner*—Eugene Kim
(74) *Attorney, Agent, or Firm*—Akerman Senterfitt

(57) ABSTRACT

For folding sheet layers the folding blade (20) forms a comb. The comb gaps (27) are closed during fold pressing and opened during transfer of the fold to a conveyor (21). Thus the conveyor (21) engages the sheet only in the region of the comb gaps and easily withdraws the sheet without pressing it into contact against the folding blade (20). For controlling the gap variations a fully mechanical cam control (30) is provided underneath the working plane (10).

8 Claims, 3 Drawing Sheets

FEED MEANS FOR SHEETS, PARTICULARLY CREASING MEANS, AND METHOD FOR ADVANCING SHEETS

This application is a continuation of 09/338,127 filed Jun. 22, 1999, now abandoned.

TECHNICAL FIELD AND BACKGROUND OF THE INVENTION

The invention relates to an apparatus or method for transporting sheets or plies superimposed and directly interconnected via a transition, termed fold in the following. The sheet layers, such as paper, are then in direct contact by their insides and form an outside by outer mutually remote faces. The insides transit via the concave curved inside of the fold and the outer faces transit via the convex curved outside of the fold. The sheets may be multi-layer on each of the two fold sides and within the fold. Then the insides are formed by the innermost layer and the outsides by the outer-most layer between which further layers are located. Such sheet piles to be folded or already folded are further processed into e.g. exercise books.

Reference is made to a transport and folding apparatus known from German patent 25 19 420 as included in the present invention with which even deep piles of sheets may be folded by a simple configuration at high speed without the risk of inherent crushing.

When the folded sheet is withdrawn from the inserter or folding blade relatively high friction may occur. The blade ensures, however, a smooth transfer of the sheet directly to a conveyor, e.g. so that it is not pulled apart. Thereby, however, the conveyor's pressure against the outside of the sheet acts via the inside directly on the blade. Thus withdrawing the blade is empeded and limits the working speed.

OBJECTS OF THE INVENTION

An object is to provide an apparatus or a method which avoids the disadvantages of known configurations or of the kind as described. Furthermore, it is intended to enable the friction with which the sheet is withdrawn from the inserter to be reduced or the working speed to be increased.

SUMMARY OF THE INVENTION

According to the invention means are provided by which the sheet is passed on to the conveyor so that the transverse or cross force of the latter acting on the outside is transmitted to the inserter only non-significantly or to a negligible degree. This cross force commonly acts on all sheets by clamping so that the sheets will not be mutually displaced due to the conveying force oriented transverse to the cross force. The sheets are transported solely by the positive friction contact with the outside. Transfer of the friction pressure to the contact between sheet and inserter is significantly reduced or even eliminated.

The impact for forcing the sheet into conveying engagement may take place in the region of an opening or discontinuity of the inserter and upstream of the conveyor on the outside. Preferably this opening at the end of the inserter is an open cutout. At this cutout the conveyor engages the outside of the sheet. Thus the conveyor presses the sheets within the opening directly against each other by their insides and not against the inserter.

Prior to reaching the conveyor these openings of the inserter may be closed with fillers. Thus the inserter's end is initially also in contact with the fold's inside at the corresponding opening zone to be opened thereafter. Thus the fold's inside or crease is formed continuously and evenly by the inserter. Prior to or while reaching the conveyor the opening's filler is removed or retracted. Thus the filler remains outside the narrowest zone of the infeed mouth of the conveying gap but may, however, protrude as far as into the flare of this gap.

The invention is expedient wherever sheets need to be withdrawn from an inserter or engaging member with reduced friction. It may also be advantageous to configure a member which engages the outside of the sheet with pressure and comotion like the conveyor so that its frontmost portion as viewed in the feed direction exerts the highest pressure. Portions of the pressing face directly adjoining downstream thereof exert a lower pressure, e.g. whilst the pressing face rolls along the outer face of the sheet. Thus the fold is additionally creased or pressed flat by being rolled against the inserter without adjoining portions of the outside exposed to an unnecessarily high pressure.

The transport or driving face which engages the outside of the sheet can be movable transverse to the outside of the sheet independent of its conveying motion. If the conveyor is a nipper or gripper its gap is widenable and closeable. Thus the pressure against the sheet's outside is variable or totally eliminatable. The fold can be introduced in the running direction between the jaws of the conveying nipper while simultaneously laying the jaws against the sheet's outsides and increasing the clamping force. Simultaneously the driving face of the nipper runs commonly with the sheet or inserter at the same speed and running direction. Thus a very gentle transfer is achieved. Thereby the nipper too, may press the fold flat or maintain it flat-pressed.

Although for controlling the motion sequences of the inserter, the transverse displacement of the conveyor, of the pressing faces electronic, hydraulic or pneumatic control means are feasible, mechanical control means are preferred. These may include a cam control. The followers guided by the curve or cam bodies are positively connected via transfer drives to the member to be controlled in each case. The transfer drive may comprise a leverage or push and pull rods or be formed solely by these.

By the method of the invention the sheet is transferred by the inserter and/or the pressing member to the conveyor, but the inserter is not exposed to the contact pressure of the conveyor.

BRIEF DESCRIPTION OF THE DRAWINGS

Example embodiments of the invention are explained in more detail in the following and illustrated in the drawings in which.

DETAILED DESCRIPTION

Figure 1:
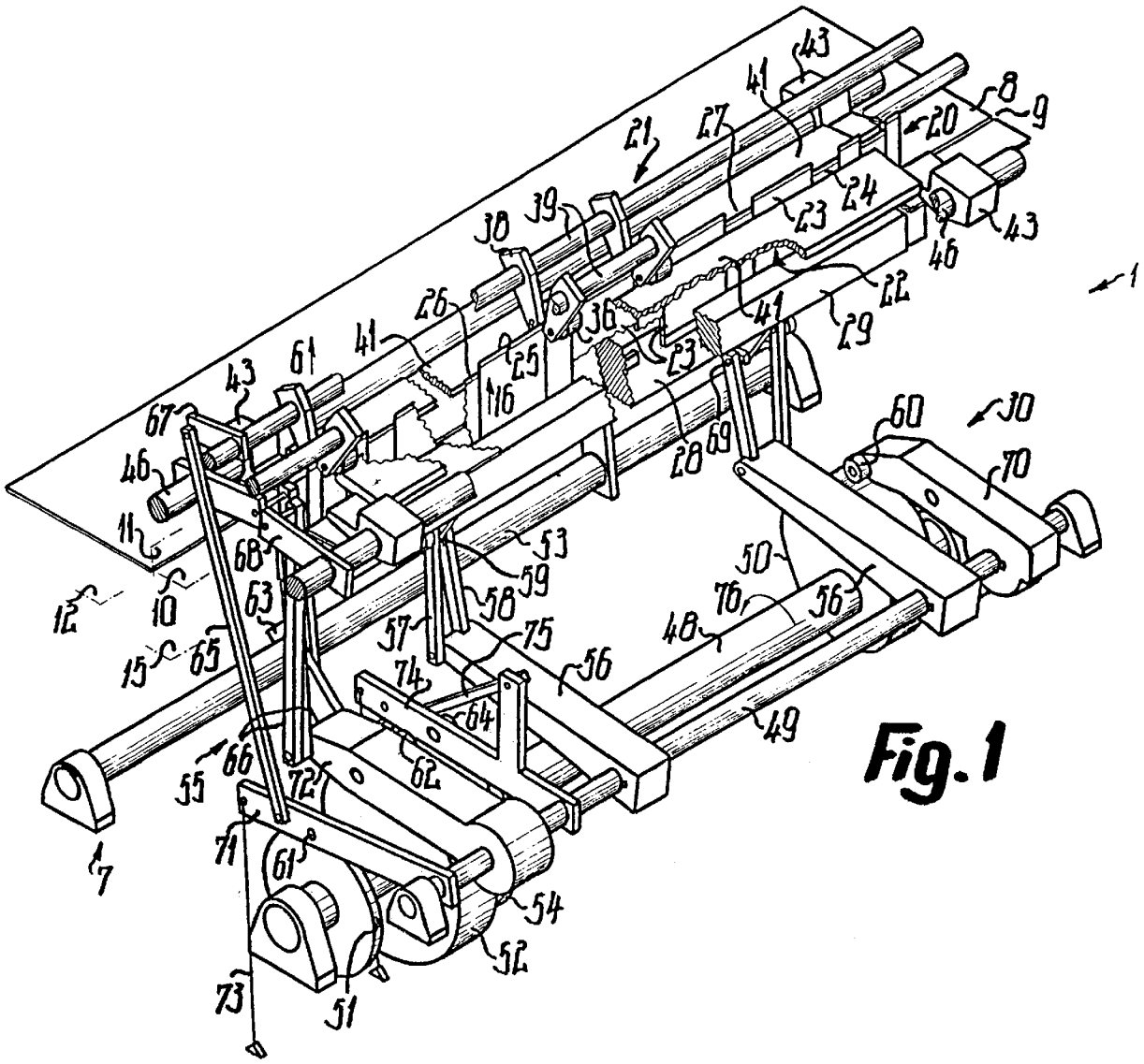
FIG. 1 is a simplified perspective illustration of the apparatus.

With apparatus 1 the method according to the invention is carried out fully automatically. Thereby a layer such as a pile of ten or more sheets of flushly stacked paper is folded over 180° to a fold 3. The two equally large fold legs are then in contact with each other by the full areas of their insides and transit into each other via the fold's inside 4. Thus they form remote outsides 5. While folding the sheet 2 is moved at right angles to its spreaded plane 10 in direction 6 or 16 relative to a stationary frame 7 and perpendicularly away from a table 8. To the upper table face the planarly spreaded sheet 2 is fed parallel to plane 10 by conveying means so that the fold zone coincides with a gap 9 traversing table 8. By the transverse motion this sheet 2 is lifted vertically upwards from the table face 10 in the fold zone so that the fold 3 and the layer legs are symmetrical to and on both sides of folding plane 11 which is perpendicular to plane 10. The sheet's length parallel to fold 3 includes multiple units and is multiply larger than the books to be produced. After folding and exit transport the sheet 2 is cross-cut into single books or the like.

In lifting from plane 10 the fold 3 reaches a plane 12 in which the outsides 5 are gripped for further transport in direction 6 or 16. Thereby up to a plane 13 which is spaced from plane 10 at least as far as plane 12 or slightly further, the inside 4 is pressure loaded directly in direction 16. Further thereby up to a plane 14 which is nearer to plane 10 than to plane 12, 13, the sheet legs are maintained parallel and slightly interspaced. Between planes 12, 14 and 13, 14 respectively the insides of the sheet legs are pressed against each other directly. Planes 10 and 12 to 14 are parallel.

Between planes 12 to 14 and plane 10 the fold 3 or sheet legs are pressed. Thereby in the pressing zone the legs are continuously interspaced up to the inside 4 and over their full length. Pressing toward plane 11 occurs on the fly through plane 15 in direction 6. Thereby the sheet legs slide under curving on the table face and lift off until they are planar. Pressing is terminated shortly before fold 3 reaches one of parallel planes 12 to 15. Then the sheet legs are free of pressure contact. Pressing occurs only over a smaller height portion of the sheet legs which portion adjoins fold 3 and whilst the legs are tangential to plane 10. This also applies for reaching planes 12 to 13.

The conveying engagement with maximum pressure transverse to plane 11 from plane 12 onwards occurs only in partial sections of the length of sheet 2. These sections are shorter than the length sections inbetween in which the pressure of the conveying engagement is relatively reduced or entirely prevented. In the vicinity of these length sections the insides of the sheet legs are thus not in contact until reaching plane 12 or 13, but only directly thereafter. Whilst pressing is carried out between and with spacings from both planes 10, 14 by an arc motion in direction 18 transverse to planes 10 and 12 to 14, the creasing pressure of ply 2 may be carried out between planes 12 to 14 by a motion in direction 19 transverse to plane 11. Direction 19 may be parallel to planes 10 and 12 to 14 or in an arc which relative to plane 11 is steeper than direction 18.

For lifting off the sheet's fold zone from plane 10 and up to planes 12 to 13 a plate inserter or folding blade 20 is provided in plane 11. In the initial position blade 20 is totally beneath plane 10 but then moved through gap 9 in direction 16. Thereby blade 20 is slidingly guided on the lateral bound faces of gap 9 and table 8. Thereby blade 20 is in contact with inside 4 over the full length by an end edge which is acutedly flanked askew on both sides. Thus blade 20 conveys sheet 2 through press 22 up to plane 14. Thereafter and up to plane 12 or 13 of conveyor 21 the blade 20 rests only against the cited length sections of inside 4 but not on the partial sections inbetween. For this purpose blade 20 is subdivided into two combs or inserter members 23, 24 of equal length. They have equal cross-sections between planes 10 and 12 to 14 and are permanently coplanar.

Each sub-member 23, 24 consists of juxtaposed fingers or strips of sheet-metal which are interspaced and freely protrude in direction 6, 16 up to their pointed ends 25 respective 26. Both remote side edges of each member 24 are slidingly guided on two opposed side edges of two adjacent members 23. The mutually equal width of fingers 23 is twice as large or larger than the mutually equal width of each of fingers 24. Both laterally outermost fingers 23 are narrower than the remaining fingers 23, 24. Up to plane 14 the end edges 26 of all members 24 are in a common line with the likewise straight end edges 25 of all members 23 and directly adjoin edges 25. Then members 24 terminate the motion in direction 16 whilst members 23 continue to run up to plane 12 or 13 in direction 16.

Thus an opening or shallow U-shaped depression 27 is formed between each two adjacent members 23. The depression bottom is formed by the accompanying end 26 and the depression flanks are formed by the side edges of these members 23. The lower ends of members 23 and 24 are exchangeably fastened to a support 28 respective 29 by tensioning screws. Slides 28, 29 have the shape of oblong beams oriented parallel to plane 10 and to edge 25, 26. Beams 28, 29 have opposed tensioning or clamping faces on which members 23 and members 24 are fixed with interspacings. Accordingly, the other slide 29 or 28 slides on the plate face of each member 23 respective 24 which faces away from the accompanying tension face. Thus members 23, 24 are guided between these tension faces with pressure and without motion play while being precisely aligned. Slides 28, 29 are located beneath plane 10 or table 8. Slide 28 is mounted for reciprocation in direction 16 on a linear guide 31 of frame 7. Slide 29 is mounted for reciprocation in direction 16 on a linear guide 32 of slide 28. Slides 28, 29 are commonly and independently displaceable in and counter direction 16 for achieving the cited positioning control of ends 25, 26. The upper.end of guide 31 supports table 8.

Conveyor 21 has for the infeed of sheet 2 a mouth 33 continuously flared counter direction 6. Mouth 33 extends between plane 10 and plane 12 or 14. In plane 12 the narrowest zone of mouth 33 is attained. Mouth 33 is bounded by driving faces 34 running in direction 6 and frictionally engaging the outsides 5 only in the vicinity of the cited partial sections. In direction 6 from plane 12 onwards these driving faces bound a conveying gap 35 for sheet 2. Gap 35 has constant width but is resiliently widenable. Mouth 33 is flanked up to plane 12 by deflections, such as circular pulleys 36 which are located on both sides of plane 11 and over which an endless conveyor belt 37 permanently rotates. Belts 37 bound mouth 33 and with faces 34 gap 35.

Opposed pulleys 36 are rotationally mounted in suspended arrangement on separate supports 38 which are pivotable on both sides of plane 11 about separate axes 39 in direction 19. The spacing between stationary axes 39 which are located above the pulley axes is always larger than the spacing between the pulley axes. In each case one gap 33 to 35 is located in the vicinity of an arm 24 or of the accompanying breach 27. On each side of plane 11 the supports 38 of all pulleys 36 are fastened to the common axis 39 while being longitudinally and rotatably adjustable on rest. Opposed supports 38 or axes 39 are directly but counterwise drivingly interlinked. This drive link 40 may act positively by two toothed wheels of equal size and arranged on axes 39. These wheels are fixed to shafts 39 and mate directly. Thus the upstream end of conveyor 21 forms a gripper to be opened and closed in direction 19 in the vicinity of gap 33, 35. The closing motion of both gripper jaws 36 has a vector in direction 6. When opening the faces 34 are at an acute angle. When closed the axes of guide pulleys 36 are located in plane 12. Above axis 39 the gap 35 is diverted transverse to a further press for pressing the fold back 3 and to a transfer station from which sheets 2 are automatically fed to a cutting station for being dismembered into separate products.

Press 22 has on each side of plane 11 a plate or strip-shaped pressing ram 41. Each ram 41 has an edge face nearest to plane 11 which is a convexly curved pressing face 42. Face 42 uninterruptedly covers the full working width of apparatus 1 or 20 or 21 or 22 and is, like ram 41, always spaced from planes 10 and 12 to 14. The end edges of each ram 41 are movably secured to two supports 43 which are fixed to an axis or shaft 46. Axes 46 are equally spaced from plane 11 and are located in plane 15 in the middle between planes 10, 14. Each axis 46 is located in the center plane of the accompanying face 42 or of plate 41 and spacedly behind the ram's length edge which is remote from its face 42. Relative to its support 43 each ram 41 is linearly shiftable with guides 44 parallel to this center plane and transverse or at right angles to plane 11 or axis 46. With respect to its supports 43 each ram 41 is spring-loaded by springs 45, like compression springs, toward plane 11 and is thus movable up to an adjustably variable stop position.

Figure 3:
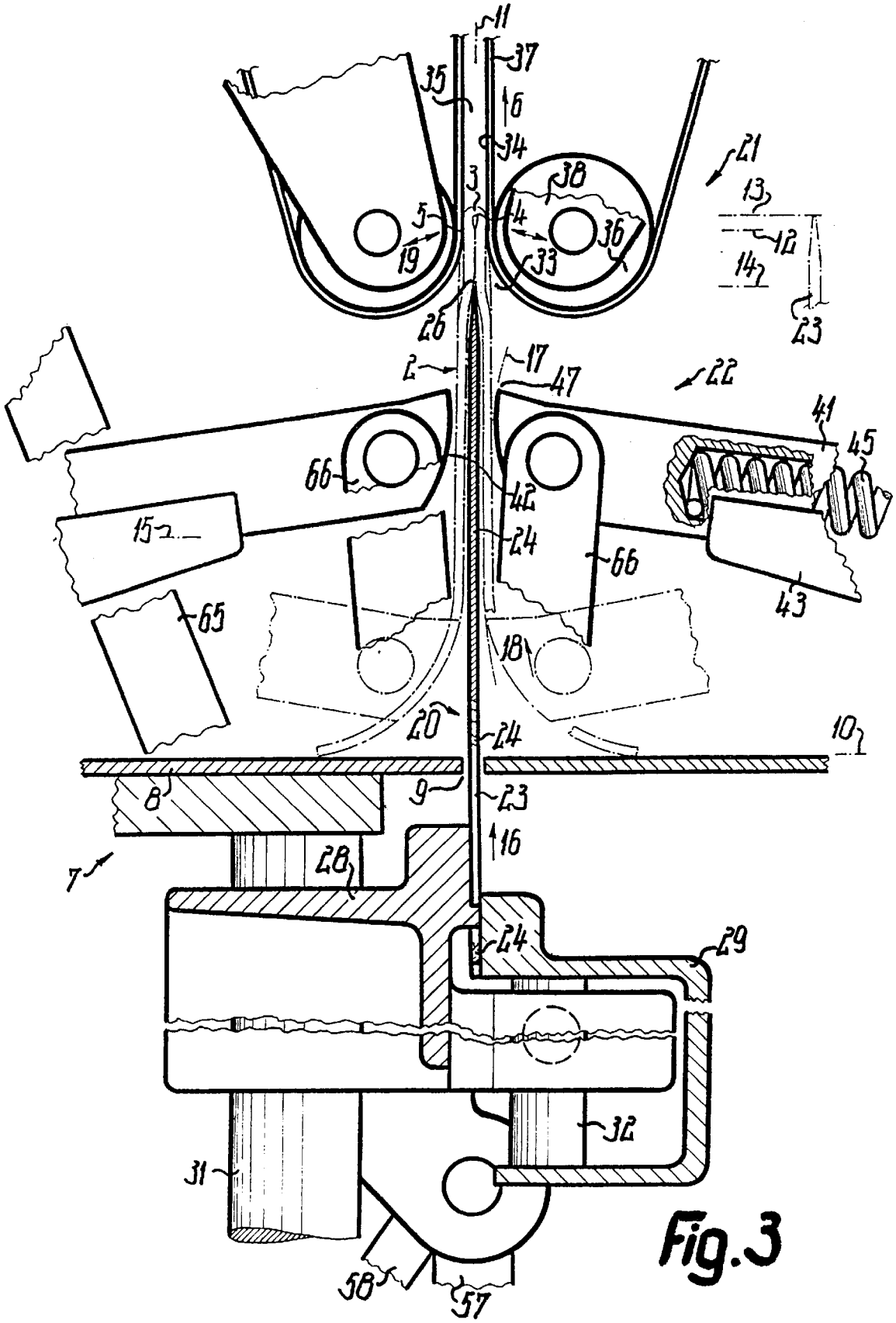
FIG. 3 is a magnified detail of FIG. 2.

As evident from FIG. 3 both rams 41 are commonly movable from the initial position shown in dot-dashed lines and nearest to plane 10 in direction 16 or 18 into the other end position as shown. In the initial position faces 42 are spaced from and located between planes 10, 15. In the other end position faces 42 are spaced from and located between planes 12 to 14 and 15. The leading end or length edge 47 of each face 42. circumscribes an arc path 17 about axis 46 when moving between the two positions. The face sections 42 adjoining upstream to edge 47 are permanently set back from this arc path. In the initial position faces 42 thus form an infeed funnel or mouth which is constricted up to edges 47 for receiving fold 3. This mouth is spaced from and directly adjacent to plane 10.

In the simultaneous motion in direction 18 edges 47 and the adjoining face sections 42 approach plane 11. Thereby the sheet legs urge faces 42, 47 counterdirectionally apart against the force of springs 45 to thus roll fold 3 flat. The highest pressing force is achieved when edges 47 reach plane 15. Thereafter the pressing force which formerly continuously increased is then continuously diminished. Pressing is carried out continuously over the full working width and against blade 20 or all members 23, 24. In the upper end position faces 42 form both the infeed mouth which is constricted in direction 16 and the outfeed mouth or funnel which widens in direction 16 up to edges 47. Sheet 2 and faces 42 are out of contact in this end position.

The feed of the non-folded sheets 2 over the retracted blade 20 and all described motions as well as the outfeed are synchronized by drive and control means 30 powered by a common motor. Control 30 comprises below table 8 and laterally adjacent to plane 11 a camshaft 48. Thereabove and farer spaced from plane 11 a control shaft 49 is mounted. On the rotary shaft 48 circumferential cams 50 to 52 and 54 are non-rotatingly mounted. On the other side of plane 11 and level with shafts 48, 49 an intermediate shaft 53 is provided for limiting the stroke of members 24 up to plane 14. Means 20 to 22 are controlled and driven by cams via a rods mechanism or leverage 55.

Levers 56 are non-rotatingly and with interspacings arranged on shaft 49. Levers 56 protrude freely toward plane 11. On the end of each lever 56 a rod 57 is pivotably mounted by its bottom end and oriented perpendicular to plane 10. The upper end of this rod is hinged to the underside of slide 28. Also a rod is hinged in the same axis as rod 57 on each transfer member 56. This rod is a knee lever 58. Its upper end is pivotably hinged to the underside of slide 29 or above. In the extended position, namely during the stroke up to almost plane 14 both knee legs of lever 58 are also perpendicular to plane 10. The effective length of rod 58 is varied with a control rod 59, adjoining the rod 58 and oriented away from the plane 11.

Cam plate 50 serves to pivot shaft 49 commonly with transfer elements 56 to 59, 69. For this a follower 60 is guided on cam 50. A corresponding follower 61 is guided on cam plate 51 to actuate conveyor 21 via intermediate elements 71, 65, 67, 39, 38. A follower 62 is guided on cam plate 52 for actuating press 22 via intermediate elements 72, 66, 68, 46, 43. A follower 64 is guided on cam plate 54 for actuating the slide 29 via the transfer elements 74, 75, 63, 59, 58 or for mutually moving slides 28, 29 or sub-members 23, 24. The intermediate members comprise an obtuse-angled bent lever 63 arranged on axis 53. Rod 59 is hinged to the upwards oriented arm of lever 63. When in the middle between its two end positions the effective axial plane of this upper arm is perpendicular to plane 10.

From levers 56 and from the free ends of corresponding levers 71, 72, 74 the control motion is transferred to associated apparatus parts via linkage 55 assembled from push and pull rods 57, 58, 65, 66. These rods are permanently oriented as perpendicular as possible to plane 10 and located between those planes of axes 36, 39 or 46 which are parallel to plane 11. Each of these rods traverses plane 11 between its hinging points.

Follower 60 is mounted at the free end of lever 70 which like levers 56 is arranged non-rotatably on shaft 49. Each of followers 61, 62, 64 is mounted on an associated lever 71, 72, 74 which in turn is rotatably mounted on shaft 49. Thus the accompanying transfer elements are actuatable independently of transfer elements 56. All levers 70 to 72, 74 freely protrude from shaft 49 toward plane 11. In the associated center position the effective axial plane of each of these levers and of levers 56 is perpendicular to plane 11. All levers are mutually independently spring-loaded by springs 73 in a downward direction or against the associated cam.

A rod 65 is hinged on lever 71 by its lower end and inclined at an acute angle to plane 11. Rod 65 passes plane 10 and is hinged by its upper end on a lever 67 which points away from plane 11 and is fixed to shaft 39. Shaft 39 is located on that side of plane 11 which is remote from shafts 48, 49. The effective axial plane of lever 67 is perpendicular to plane 11 when nippers 21 are in center position. Follower 61 lies between the lower hinge point of rod 65 and shaft 49. To the free end of lever 72 separate rods 66 are hinged by their lower ends. Thus their common hinge axis may be coaxial with the accompanying hinge axes of rods 57, 58 while these hinge points are equally radially spaced from axis 49. Rods 66 diverge upwards at an acute angle, traverse plane 10 and are separately hinged by their upper ends to the opposed ends of levers 68.

Figure 2:
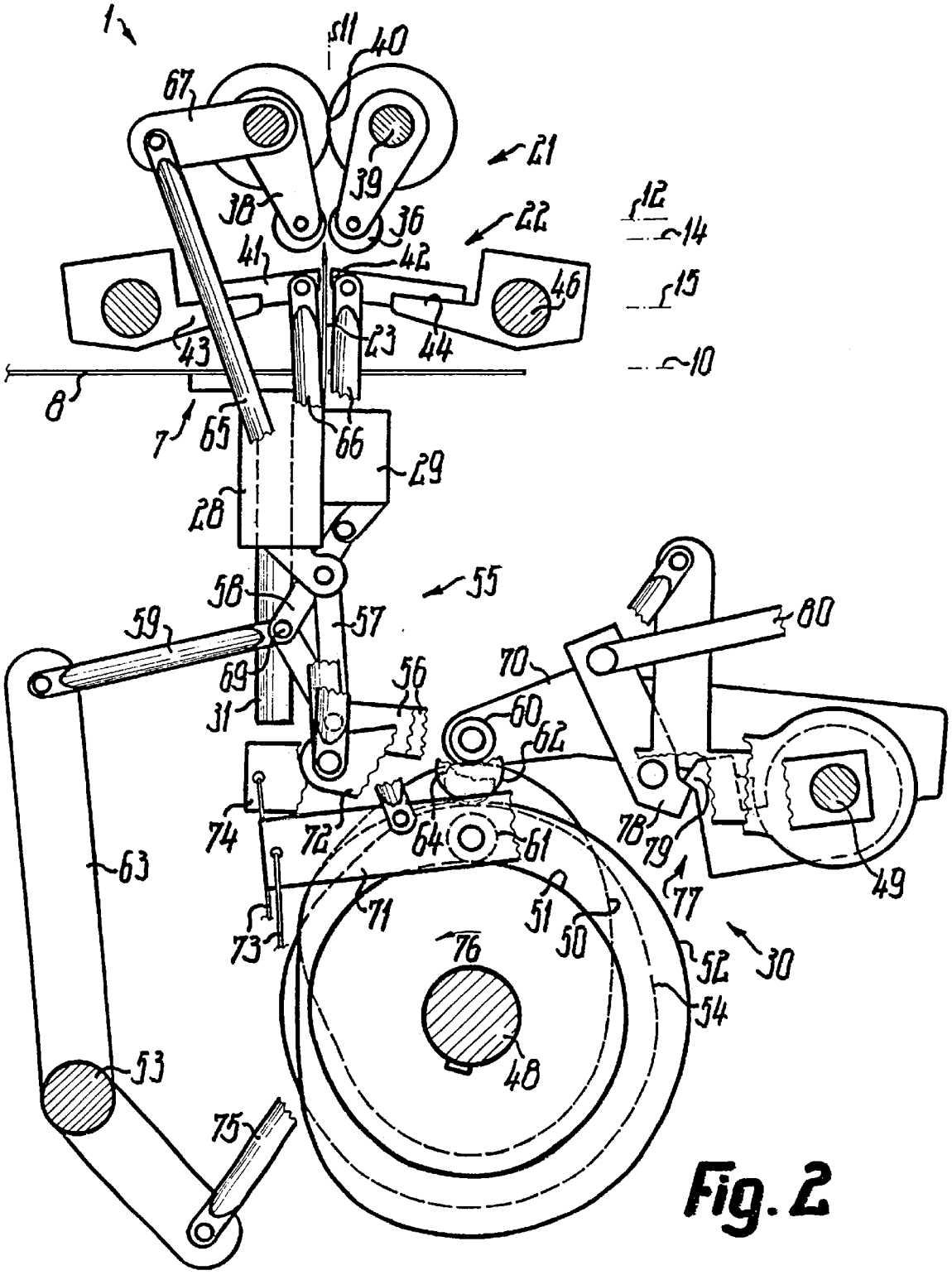
FIG. 2 is a left-hand view of the apparatus of FIG. 1.

Each lever 68 is firmly seated on the accompanying shaft 46 and freely protrudes toward plane 11. In the cited center position of press 22 the levers 68 are perpendicular to plane 11. The hinge axis between rod 66 and lever 68 is located below the center plane of face 42 which is parallel to this hinge axis. This hinge axis is located in an axial plane which is common with the accompanying deflection 36 and parallel to plane 11 when this deflection 36 is closest to plane 11 as FIGS. 2 and 3 show. The upper end of a rod 75 is hinged to lever 74 between shaft 49 and follower 64 or above shafts 48, 49 and levers 56 and 70 to 72. The lower end of rod 75 is hinged to the shorter arm of lever 63 with a spacing from shaft 63 which is smaller than the accompanying hinge spacing of rod 59. This shorter arm protrudes downward and is inclined to plane 11. Both hinge points of rod 75 are located on both sides of plane 11. The length of each rod 57, 58, 59, 65, 66 and 75 is continuously variable for setting. This also applies to each of the individual levers of toggle joint 58. Furthermore, the effective axial plane of each of levers 56, 70 to 72 and 74 is perpendicular to plane 11 when in its center position.

The axis of each of the rotating bodies or linkages 36, 38 to 41, 43, 46, 48 to 54 and 56 to 75 is parallel to planes 10 and 11. The axes of shafts 39, 46, 48, 49, 53 are permanently stationary relative to frame 7.

Operation and Method

Shaft 48 and the non-rotatably fixed cams 50 to 52, 54 rotate as shown in FIGS. 1 and 2 continuously counter-clockwise in direction 76. Thus slides 28, 29 and blade parts 23, 24 are reciprocated over an adjustable stroke between their upper and lower end positions at continuously varying speeds. Thereby and below plane 14 the ends 25, 26 or upper sides of slides 28, 29 are permanently aligned level. Before or whilst thus the ends 25, 26 downwardly traverse faces 42 the press 22 is lowered to its initial position which it attains when blade 20 has reached its lower reversing point or shortly after it has commenced its upward motion. At this moment—or shortly before—mouth 33 also starts to open. Lever 58 is extended so that edges 25, 26 are in line. Before blade 20 reaches gap 9 the spread-out sheet 2 is fed over gap 9 and immediately seized by edge 25, 26. Thus sheet 2 in forming fold 3 is elevated into the region of faces 42 which still stand in initial position. This region forms in the upper end position (FIG. 3) the transition between the infeed and outfeed funnels. This region is nearer to edge 47 than to the lower end of faces 42. On attaining this region the faces 42 run synchroneously with fold 3 and roll it against the inclined flanks of ends 25, 26. As of having attained the coplanar center position of rams 41 the rolling pressure of faces 42 is continuously reduced up to their upper end position and until faces 42 fully release from the sheet legs to then being traversed by the aligned flush ends 25, 26. Faces 42 are continuously held in this alignment up to the cited return stroke of blade 20.

Ends 25, 26 commonly still ascend toward plane 14. Shortly before plane 14 is reached members 24 with slide 29 are progressively decelerated relative to unit 23, 28 until the differential stroke needed to form gaps 27 is executed and until firstly ends 26 have reached plane 14 and secondly ends 25 have reached plane 13 (FIG. 3). On entry of fold 3 into plane 12 and while being supported by ends 25 the pulleys 36 reach on their before started closing motion the closed position for gap 33, 35. Pulleys 36 thus press the insides of the sheet legs directly against each other in each of the at least five or seven gaps. Between these gaps 27, where in their upper end position 13 the upper ends 25 of members 23 engage between the sheet legs, no such transverse pressing takes place. In this region folded sheet 2 is thicker by blade 20 than in the region of gaps 27. In their upper end position 14 the upper ends 26 are above those zones of members 36, 37 which are nearest to plane 10. Thereby ends 26 have a spacing from plane 12 which is smaller than the radius of members 36, 37. Shortly before fold 3 attains plane 12 it is seized by the permanently continuously revolving faces 34 and synchroneously driven by members 23 up to attaining plane 13. Then fold 3 is entirely withdrawn from blade 20 or members 23, 24 in direction 6 to then being further conveyed to the back press.

Whilst members 23, 24 pass through their upper reversing points in directly interconnected motions, the spacing 13 to 14 of ends 25, 26 is still maintained over a first section of the downward motion while press 22 remains in the upper end position.

Whilst thus blade 20 is lowered with increasing speed, the ends 25, 26 in passing through press 22 are brought into alignment by closing gaps 27. Thereby members 24 move downward slower than members 23. The relative speed between slides 28, 29 is highest at its start and diminishes up to the aligned position. This motion terminates shortly before reaching the lower reversing point. This point is maintained over two-fifths of a full motion cycle or over 140° of a revolution of shaft 48. Relative thereto nippers 22 remain in upper end position longer. During this time the next sheet 2 is run in one go over stationary gap 9 either parallel or perpendicularly to this gap 9. Thereby, sheet 2 is aligned until it abuts on a transverse stop. It is not until then that press 22 commences its motion down to the lower end position which it attains on commencement of the new stroke of folder 20. Nippers 21 remain closed over the majority of each cycle, namely 315° of a cam rotation. Its opening commences or is attained whilst press 22 attains its lower end position and whilst blade 20 commences its upward stroke. Its closure commences or is attained when blade 20 has traversed press 22 or prior to engagement of blade 20 and sheet 2 on nippers 21 or after members 23, 24 have commenced their relative motion or when this relative motion is completed in forming gaps 27. The upward motion of blade 20 is faster in the first stroke section than whilst ends 25, 26 traverse press 22 and is again faster thereafter. Similarly, shortening of lever 58 may be quicker at the start than towards the end. Modulation of the motion sequences is evident from the curved shapes shown in FIG. 2.

The control of the relative motion of slide 29 without, although possible, resilient stops results in damping the mass forces. Thus smooth operation with low shock and vibration is assured even at a high running speed. Up to a hundred or more folds or stroke cycles or revolutions of shaft 48 may be implemented per minute. Since many parts are symmetrical to plane 11 or to a center plane which is perpendicular to one of planes 10, 11 these parts may be used optionally on both sides of plane 11 to the same degree. This applies e.g. to units 36, 38, 39, to units 41 to 45 or to their component parts as identified by separate reference numerals or to rods 66. The entire control is space-savingly located below table 8. Thus plane 10 is traversed only by rods 65, 66.

Means 77 are provided for preventing apparatus 1 from being overloaded or for interrupting control connections to easier set the apparatus. Means 77 form a releasable drive link or coupling between unit 60, 70 and linkage 55 or levers 56. Lever 70 is rotatably mounted on axis 49. A slaving driver 78 or catch is pivotably mounted on lever 70 between follower 60 and axis 49. Pawl 78 drivingly engages a counter member 79 in the sense of the lifting motion of blade 20. This engagement is positive but automatically releases counter a spring force when a predetermined driving force is exceeded. Thus the drive link between follower 60 and members 23, 24 is open-circuited, e.g. should blade 20 become jammed by a pile-up of sheets 2. Counter member 79 is a lever which is mounted on axis 49 or non-rotatably connected to lever 56. Lever 79 freely protrudes toward plane 11 and driver 78. Driver 78 is formed by the shorter downwardly pointing arm of a two-armed lever. The longer upwardly pointing arm is connected to an actuating member of a control 80. By means of control 80 the release force of means 77 or the cited spring force is continuously variable. When control rod 80 is coaxially connected e.g. to a pneumatic cylinder or piston rod the coupling 77 may be optionally engaged and disengaged therewith. This cylinder drive is fixed or pivotably mounted on a support which is arranged on axis 49 or on the bearing thereof.

The cited features, such as properties, effects, configurations etc. may be provided precisely as described, or merely substantially or approximately so and may also greatly deviate therefrom depending on the particular requirements. "Perpendicular" and corresponding terms shall also be understood to include transverse orientations which may deviate from a right angle.

What is claimed is:

1. Feed means for advancing a sheet including a transition with an inside and an outside remote from the inside, comprising:

a frame which is stationary;

a conveyor for conveying the sheet in a feed direction; and an inserter for subdividing the sheet into sheet legs interconnected by the transition, said inserter including a leading end subdivided into first and second end sections, both said first and second end sections operationally contacting the sheet, wherein said second end section is displaceable with respect to said first end section;

wherein said conveyor includes a conveying gap juxtaposed with said first end section and including an inlet for the sheet, said second end section opposing said inlet, in bilateral view into said conveying gap both said first and second end sections being thinner than said conveying gap while the transition engages inside said conveying gap and while both said first and second end sections commonly directly contact the sheet.

2. Feed means for advancing a sheet including a transition with an inside and an outside remote from the inside, comprising:

a frame which is stationary;

a conveyor for conveying the sheet in a feed direction;

and an inserter for subdividing the sheet into sheet legs interconnected by the transition, said inserter including a leading end subdivided into first and second end sections;

wherein said second end section is displaceable with respect to said first end section, said conveyor including a conveying gap juxtaposed with said first end section and including an inlet for the sheet, said second end section opposing said inlet; and wherein said second end section is provided on a finger freely projecting toward said second end section.

3. Feed means for advancing a sheet including a transition with an inside and an outside remote from the inside, comprising:

a frame which is stationary;

a conveyor for conveying the sheet in a feed direction;

an inserter for subdividing the sheet into sheet legs interconnected by the transition, said inserter including a leading end subdivided into first and second end sections, wherein said second end section is displaceable with respect to said first end section; and a creaser for creasing the sheet at the transition, wherein said creaser includes a first pressing face and a second pressing face opposing said first pressing face, said first pressing face being displaceable commonly with the transition in a creasing direction and thereby defining a leading face end, in the vicinity of said leading face end said pressing face pressing stronger against the sheet than upstream of said leading face end.

4. Feed means for advancing a sheet including a transition with an inside and an outside remote from the inside, comprising:

a frame which is stationary;

a conveyor for conveying the sheet in a feed direction;

an inserter for subdividing the sheet into sheet legs interconnected by the transition, said inserter including a leading end subdivided into first and second end sections, wherein said second end section is displaceable with respect to said first end section; and a creaser for creasing the sheet at the transition between first and second pressing faces, wherein said creaser includes a first pressing member displaced in a creasing direction whiled creasing the sheet, said first pressing face defining a leading end where said first pressing face initially comes into contact with the sheet and a trailing end where said first pressing face lifts off the sheet when creased, a drive member being included and connecting to said first pressing member in a drive axis spaced from said first pressing face by a drive spacing, said first pressing face defining a substantially linear pressing extension from said leading end up to said trailing end, said drive spacing being maximally as large as said pressing extension.

5. Feed means for advancing a sheet including a transition with an inside and an outside remote from the inside, comprising:

a frame which is stationary;

a conveyor for conveying the sheet in a feed direction, and an inserter for subdividing the sheet into sheet legs interconnected by the transition, said inserter including a leading end subdivided into first and second end sections, wherein said second end section is displaceable with respect to said first end section; and a creaser operationally creasing the sheet at the transition in a creasing plane, wherein said conveyor includes a driver directly contacting and displacing the sheet substantially parallel to said creasing plane, drive means being included and operationally positively directly displacing said driver transverse to said creasing plane.

6. The feed means according to claim 5, wherein said driver laterally bounds a conveying gap, said drive means including a motor driven shaft positively drive connected with said driver.

7. A method for advancing a sheet having a transition with an inside and an outside remote from the inside, an engaging face at the inside of the transition, and a bite-in face at the outside of the transition, said method comprising the steps of:

contacting the engaging face at the inside of the transition with a contact face to feed the sheet in a feed direction, and contacting the bite-in face at the outside of the transition to pull the sheet away from being contacted at the engaging face;

wherein contacting of the engaging face is released by positively withdrawing the contact face from the inside of the transition while sliding the contact face on the sheet, and simultaneously pulling the engaging face away from the contact face by contacting the bite-in face.

8. The method according to claim 7, wherein the bite-in face is oppositely contacted by a progressively closing grip action while stressing the sheet in the feed direction at at least one of the engaging face and the bite-in face, and while keeping said contact face away from the grip action.

* * * * *